US005711447A

United States Patent [19]

Plester

[11] Patent Number: 5,711,447

[45] Date of Patent: Jan. 27, 1998

[54] EASY-OPEN RESEALABLE CAN-END AND CLOSURE THEREFOR

[75] Inventor: George Plester, Brussels, Belgium

[73] Assignee: The Coca-Cola Company, Atlanta, Ga.

[21] Appl. No.: 695,366

[22] Filed: Aug. 9, 1996

Related U.S. Application Data

[63] Continuation of Ser. No. 313,886, Sep. 28, 1994, abandoned.

[51] Int. Cl.[6] ..... B65D 51/18

[52] U.S. Cl. ..... 220/254; 215/252; 215/253; 215/227; 215/335; 220/276; 220/295; 220/296; 220/301; 220/522; 220/906

[58] Field of Search ..... 215/252, 253, 215/227, 228, 329, 330, 334, 336, 43, 46, 274, 335, 275, 276; 220/295, 296, 301, 254, 276, 709, 521, 522, 266, 319, 255, 375, 906

[56] References Cited

U.S. PATENT DOCUMENTS

| | | | |
|---|---|---|---|
| 1,028,718 | 6/1912 | Hammer | 215/336 |
| 2,063,157 | 12/1936 | Gray | 215/339 X |
| 2,398,553 | 4/1946 | Nyden | 215/334 |
| 3,208,620 | 9/1965 | Herdering | 220/306 X |
| 3,561,631 | 2/1971 | Hatfiled et al. | 220/257 X |
| 3,572,540 | 3/1971 | LaCroce | 220/254 |
| 3,690,499 | 9/1972 | Westfall et al. | 215/274 X |
| 3,717,276 | 2/1973 | Luczak et al. | 220/257 X |
| 3,834,579 | 9/1974 | LaCroce | 220/257 X |
| 3,850,329 | 11/1974 | Robinson | 215/274 X |
| 3,931,905 | 1/1976 | Shumway et al. | 220/278 |
| 4,083,471 | 4/1978 | Frank | 220/269 |
| 4,202,462 | 5/1980 | Imber | 220/295 X |
| 4,260,067 | 4/1981 | Andruchiw | 215/274 X |
| 4,275,817 | 6/1981 | Patton | 215/330 X |
| 4,335,825 | 6/1982 | Sakazume | 220/377 X |
| 4,473,168 | 9/1984 | Cox | 220/359 X |
| 4,576,305 | 3/1986 | Saunders | 220/269 |
| 4,643,330 | 2/1987 | Kennedy | 220/288 |
| 4,747,500 | 5/1988 | Gach et al. | 220/377 X |
| 4,883,187 | 11/1989 | Knitzer | 215/228 X |
| 4,884,706 | 12/1989 | Julian | 215/252 |
| 4,938,370 | 7/1990 | McBride | 215/252 |
| 5,056,659 | 10/1991 | Howes et al. | 215/228 X |
| 5,080,246 | 1/1992 | Hayes | 215/252 |
| 5,147,057 | 9/1992 | Marshall et al. | 220/709 X |
| 5,163,571 | 11/1992 | Morini | 215/252 |
| 5,215,204 | 6/1993 | Beck et al. | 215/252 |
| 5,246,125 | 9/1993 | Julian | 215/252 |
| 5,360,126 | 11/1994 | Snyder et al. | 215/252 |

FOREIGN PATENT DOCUMENTS

| | | |
|---|---|---|
| 1494200 | 9/1967 | France . |
| 1173765 | 2/1969 | United Kingdom . |

*Primary Examiner*—Allan N. Shoap
*Assistant Examiner*—Robin A. Hylton

[57] ABSTRACT

A twist-on/twist-off resealable assembly for a can-end, such as a metal can used in the beverage industry includes a first set of knuckles formed on the can body near its top opening. A plurality of cooperating fingers on the inside of the can lid engage the knuckles so that the lid is tightened by its progressive downward motion as the lid is rotated. The lid also includes a weakened or frangible portion for forming a straw opening. A second set of knuckles are located below the top set of knuckles for engagement by fingers extending from a pilfer-proof ring. The twist-off can lid may be made from the same metal as the can body or alternatively from a transparent plastic material or a combination of metal and plastic.

7 Claims, 3 Drawing Sheets

EASY-OPEN RESEALABLE CAN-END AND CLOSURE THEREFOR

This application is a continuation of application Ser. No. 08/313,886 filed on Sep. 28, 1994, now abandoned.

BACKGROUND OF THE INVENTION

The present invention relates to a twist-on/twist-off, resealable assembly for a can end, such as a metal can used in the beverage industry. More specifically, the present invention relates to a resealable can end assembly which is easy to open and reseal by twisting of the closure on the can end.

Current can-ends for beverage cans are generally of the "ring-pull" or "press-down-stay-on-tab" type and have some disadvantages.

The are generally not resealable. The tabs are difficult to open and the opening size/shape are not ideal for drinking. Furthermore, the product is not visible through the can-end.

Most current can-ends for beverages are aluminum, and since these are joined to the can-body by roll-seaming, recycling is more difficult when using steel-body cans. A design of a can-end which is either less firmly attached to the body, or easily produced from either steel or aluminum, would be environmentally-friendlier by enabling single-material packages.

Finally, designs of can-ends which enable easy inclusion of a hidden-gift, or other promotional material, which is only accessible when the can is opened, would give significant promotional advantages in the market-place, compared with current can-ends.

SUMMARY OF THE INVENTION

Accordingly, it is the object of this invention to provide can-ends systems, which are recloseable, easy-open, easy-drink; which can offer product visibility; and which enable single-metal can-systems and hidden gift promotional possibilities.

The foregoing and other objects of this invention are fulfilled by providing a resealable can end assembly comprising:

- a cylindrical can body having an open end and a closed end with a closure engaging finish extending around the exterior surface of the can body adjacent the open end;
- a cylindrical closure having a depending peripheral skirt for operatively engaging said finish;
- a first type of spaced knuckles on said finish, said knuckles having angular surfaces on undersides thereof;
- a plurality of spaced fingers on the skirt for engaging the angular surfaces on the knuckles when the closure is tightly secured to the open end by relative rotation of said skirt and finish in a closing direction, said fingers releasing from the knuckles in response to relative rotation in an opening direction;
- a second type of spaced knuckles disposed on the finish of the can; and
- a pilfer-proof ring detachably secured to the bottom of said skirt having projecting fingers for engaging said second type of knuckles.

The can-lid with a twist-on closure feature, includes protrusions ("knuckles") formed on the can-body near its top opening, on which the fingers of the lid locate so that the lid is tightened by its progressive downward motion, when it is turned and the said fingers are forced to follow the downward angle on the bottom of the "knuckles". The lid has two sections separated by a deliberately-weakened portion, which is achieved by perforating the lid-material, or similar means. During can closing, the lower part of these said two sections is forced onto further "knuckles" which are formed near the top of the can-opening, and arranged so that this section can no longer be removed from the can-body, and so that the action of opening breaks the said weakened-portion, separating the said two sections and providing evidence of opening. The twist-off can-lid can be made from the same metal (or material), as the can body, or alternatively from a transparent plastic (enabling product visibility), or from a metal/plastic combination (enabling additional pressure-holding strength as well as product visibility)

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1A:
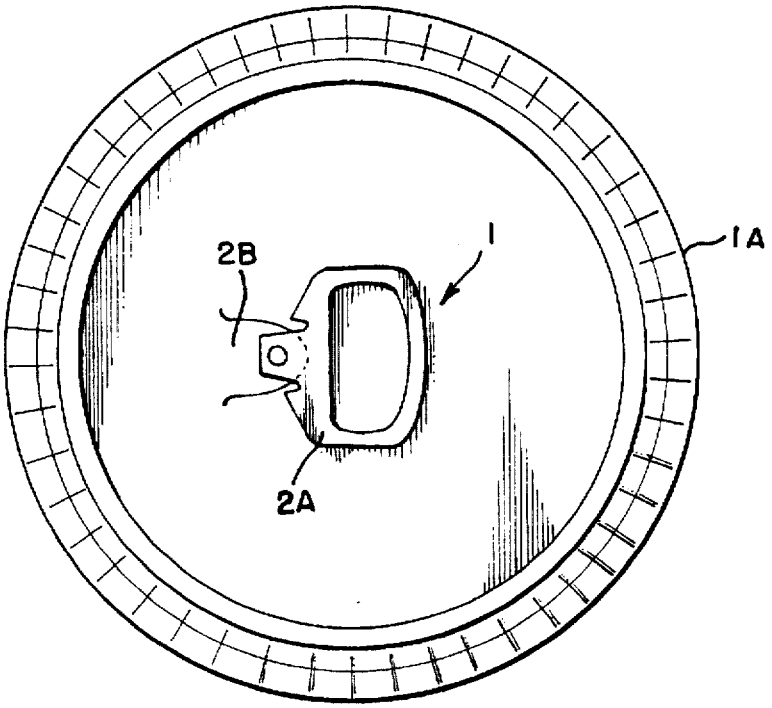
FIGS. 1A to 1D show an embodiment of an all-metal, or all-plastic, twist-off can-lid, with an additional opening for a straw.

Referring now to FIGS. 1A–1D, depicted thereat is an embodiment of the invention comprising a twist-on can lid 1 for a can 5. The lid 1 includes a skirt having two separable sections, an upper body section 1A and a lower body section 1B. The lower body section 1B comprises a pilfer-proof ring 8. The two body sections 1A and 1B can be separated by twisting at a weakened frangible perforation shown by reference numeral 10.

Figure 1B:
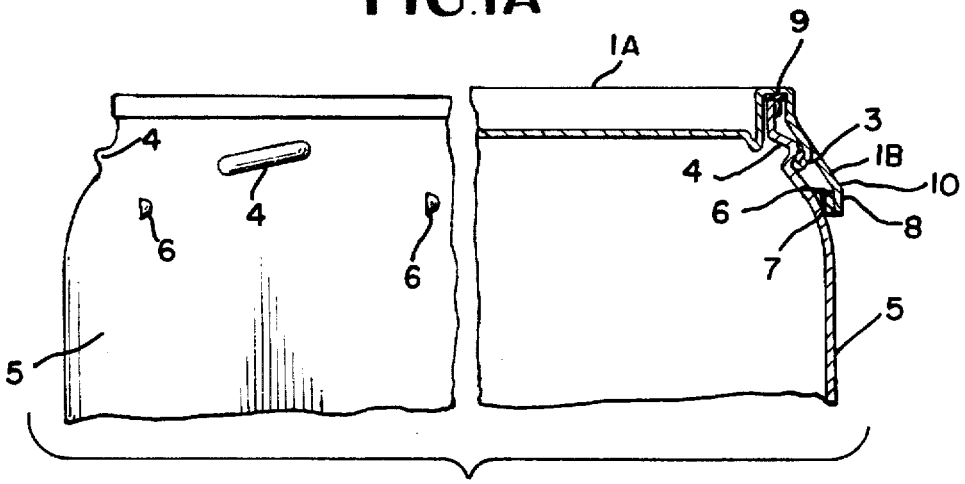
Figure 1C:
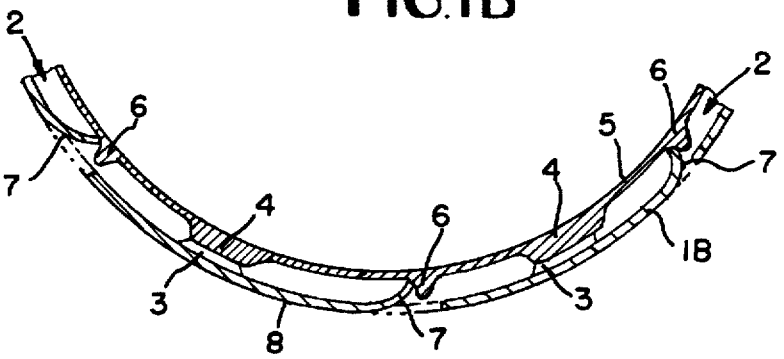
Figure 1D:
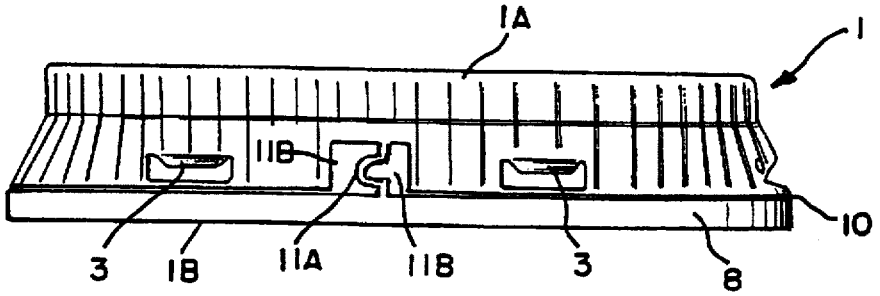

FIG. 1A shows the top view of the lid 1 with a ring-pull 2A connected to a frangible opening 2B for a straw. The user can either twist-off the lid 1 to open the top of the can 5 fully, or use the straw opening 2. FIG. 1B shows the closing features of the lid 1, where a first set of inwardly projecting fingers 3 located on the upper body portion 1A and adapted to grip a multiplicity of "knuckles" 4 pressed into the can 5 sidewall in such a way as to give a progressive downward motion ("twist-on") to the lid 1 as it is rotated, compressing seal 9. A multiplicity of smaller locating "knuckles" 6 are also pressed into the can 5 sidewall below the "knuckles" 4 and these are gripped by a second set of pilfer-proof fingers 7 located on the pilfer-proof ring 8 and which curve inwardly as shown in FIG. 1C. The locating "knuckles" 6 are shaped so that once the pilfer-proof fingers 7 pass over them to the closed position, these pilfer-proof fingers 7 prevent further rotation and removal of the pilfer-proof ring 8 from the body of the can 5. The lid 1 has a top-surface which enables normal nesting of other can bases placed on top of it. FIG. 1C shows the action of the "knuckles" 6 and the fingers 3, which provide the "twist-on" closing function, and of the pilfer-proof fingers 7 and locating "knuckles" 6, which locate the pilfer-proof ring 8. FIG. 1D shows the side of the lid 1 and in particular the fingers 3, the pilfer-proof ring 8 forming the lower section 1B, the frangible perforation 10 and a stay-on strap 11A comprising a thin flexible strip of material including a bend therein connected between the upper body section 1A and the lower section 1B, i.e. the pilfer-proof ring 8. The flexible strip 11A is located in the rectangular aperture 11B in the lower section 1B and maintains a connection between the elements 1A and 1B when the perforation 10 is broken such as by twisting and the upper body section 11A of the lid is removed from the top of the can 5.

Figure 2A:
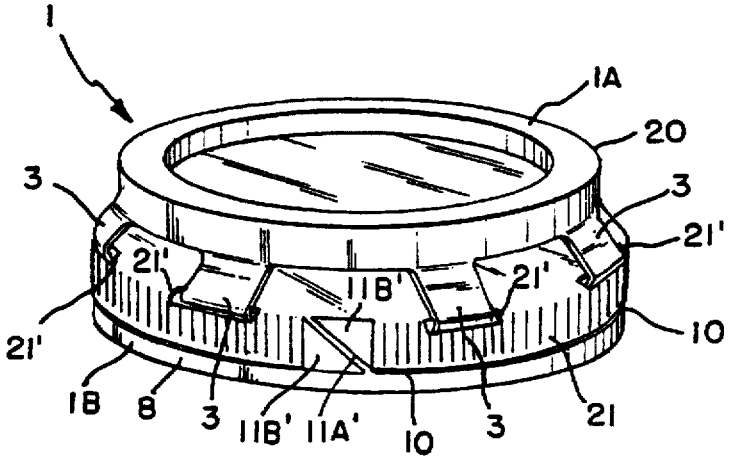
FIGS. 2A to 2E shows a further embodiment, which is a variation of that shown by FIG. 1, and demonstrates a combined metal and plastic twist-off can-lid, with the possibility of providing product visibility by using a suitable transparent plastic.
Figure 2B:
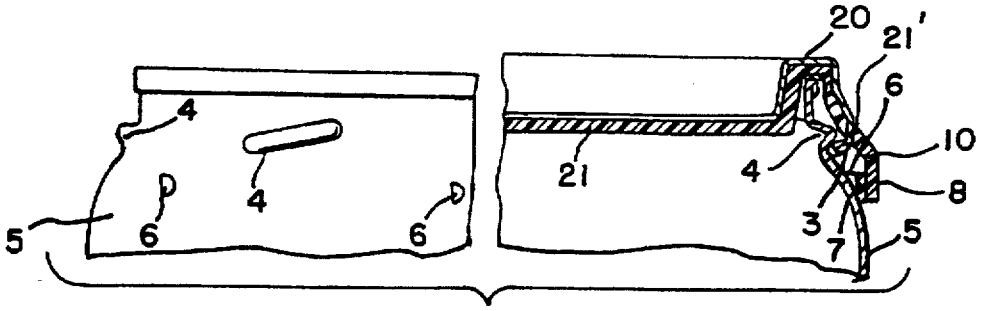
Figure 2C:
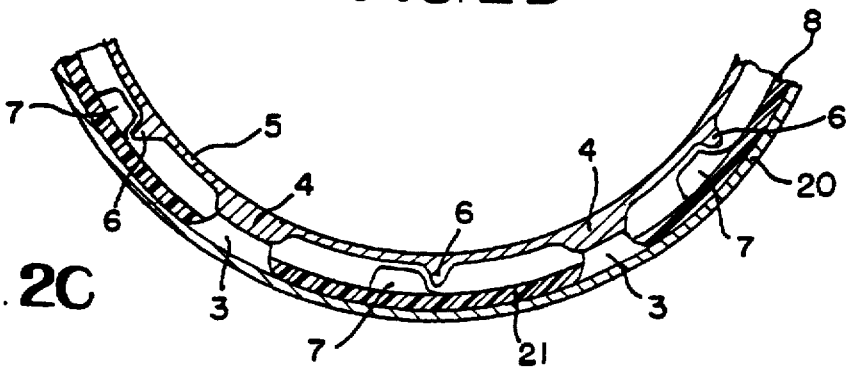
Figure 2D:
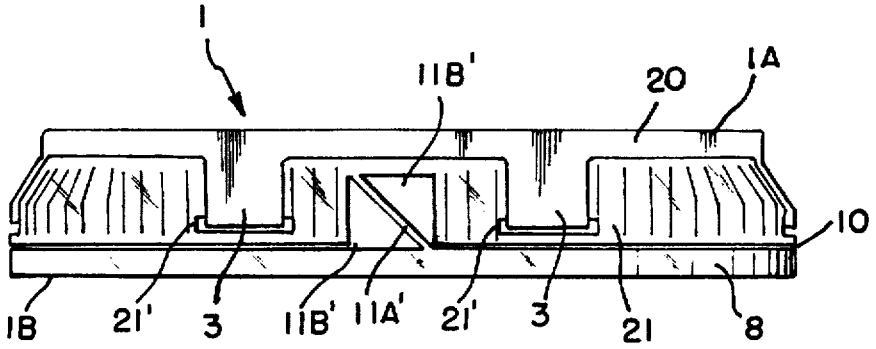
Figure 2E:
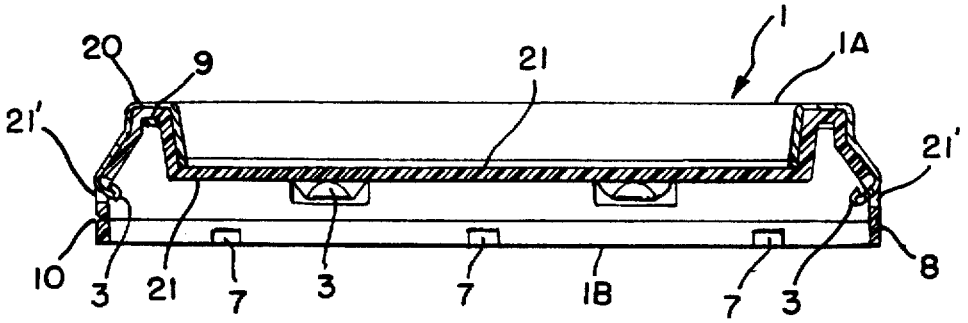

FIGS. 2A–E show a variation of the embodiment in FIG. 1, wherein FIG. 2A the principal difference is the replacement of lid 1, in FIG. 1, by two distinct parts. One part is a metal holding-ring 20, which incorporates the fingers 3, and the second part is a plastic cover 21, preferably of transparent material, which incorporates the pilfer-proof ring 8, the pilfer-proof fingers 7 as shown in FIG. 2E and the stay-on strap 11A' which also comprises a thin flexible strip of material but now is in the form of a diagonal member across a rectangular shaped aperture 11B' in lower lid section 1B. In both embodiments, the shape of the hold-on straps 11A and 11A'maintains a connection between the upper lid portion 1A and the lower lid section 1B once the frangible perforation is broken. In FIG. 2B the fingers 3 on the holding-ring 20 connects with inclined lower surface of the "knuckles" 4 on the can 5 via respective slots 21' formed in the plastic cover 21, and the pilfer-proof fingers 7 connect with the locating knuckles 6 in the can 5, similarly as in FIG. 1B. FIG. 2C shows the action of knuckles 6 and fingers 3, which provide the same twist-on closing function as the embodiment in FIG. 1. FIG. 2C also shows the pilfer-proof fingers 7 and locating-knuckles 6, which locate the pilfer-proof ring 8. FIGS. 2D and 2E show further detail of the features of holding-ring 20 and the plastic cover 21 and the thin flexible hold-on strip 11A' located in the aperture 11B' formed in the sidewall of the plastic cover 21 which essentially enable these two parts to fulfil together the same function as that described for the lid 1 in the embodiment shown in FIG. 1.

Figure 3:
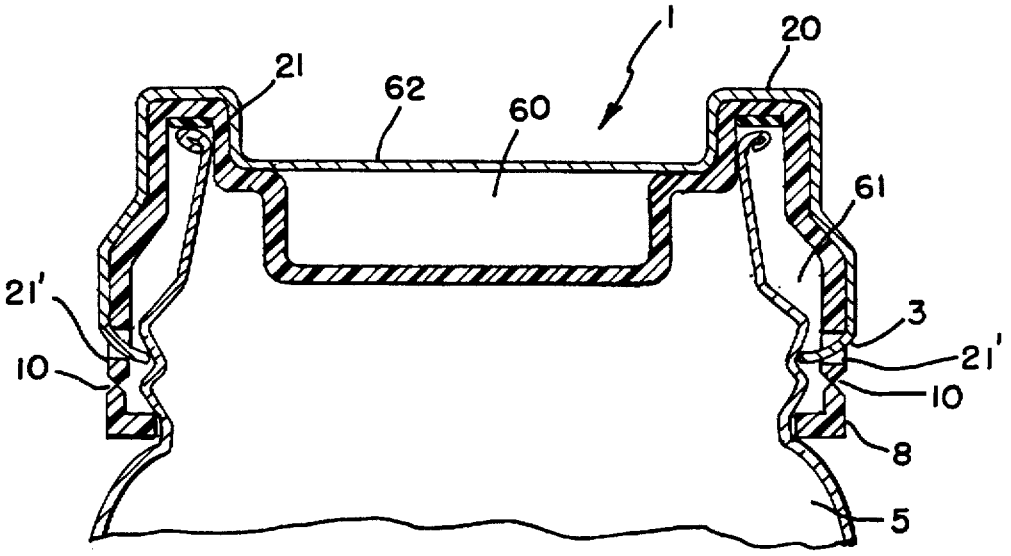
FIG. 3, shows options for promotional purposes in conjunction with the embodiments demonstrated in FIGS. 1 and 2.

By way of example, FIG. 3 shows promotional possibilities in conjunction with the twist-on-off lid 1 version demonstrated by FIG. 2. The metal holding ring 20 extends to cover the plastic cover 21 thus permitting a hidden compartment 60, which is usable for gifts, prizes, etc. A side-space 61 can also be created for labels, information material, etc. The underside 62 of the metal holding ring 20 can also be used for printing messages, collect-me-pictures, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A resealable can end closure assembly comprising:

a cylindrical can body having an open end and a closure engaging finish extending around the exterior surface of the can body adjacent the open end;

a cylindrical closure having a depending peripheral skirt for operatively engaging said finish;

a set of first type spaced knuckles on said finish, said first type knuckles having respective inclined surfaces on undersides thereof;

a first plurality of inwardly projecting spaced fingers on said skirt for engaging the inclined underside surfaces on the set of first type spaced knuckles when the closure is tightly secured to the open end by the rotation of said skirt on the finish in a closing direction, said first plurality of fingers releasing from the knuckles in response to rotation of said closure in an opening direction;

a set of second type spaced knuckles disposed on the finish of the can below said set of first type knuckles;

said closure additionally including a pilfer-proof ring detachably secured to the bottom of said skirt by a frangible perforation, said pilfer-proof ring having an inwardly projecting second plurality of spaced fingers for engaging said set of second type knuckles for preventing removal of said ring from the can body when said closure is first secured to the open end of the can body; and a relatively thin holding strap of flexible material connecting the pilfer-proof ring to the skirt and located within a rectangular aperture formed in the skirt so as to maintain a connection between the skirt and ring when the frangible perforation is broken.

2. The assembly of claim 1 wherein said closure further includes a frangible portion in a top surface thereof for accommodating a drinking straw.

3. The assembly of claim 2 further including a pull-tab connected to said frangible portion.

4. The assembly of claim 1, wherein the skirt comprises an upper outer section of metal and a lower inner section of plastic, wherein said outer section comprised of metal further comprises a metal holding ring over the inner section of plastic and including said fingers for engaging said set of first type knuckles and wherein said fingers distend from said ring and include outer end portions passing through respective slots in a sidewall of the inner section.

5. The assembly of claim 4 further including a sealed compartment for housing a prize below a top surface of the closure.

6. The assembly of claim 1 further including a sealed compartment for housing a prize below a top surface of the closure.

7. The assembly of claim 1 further including a resilient sealing element between the closure and the open can end.

* * * * *